US007830336B2

(12) United States Patent
Takasugi

(10) Patent No.: US 7,830,336 B2
(45) Date of Patent: Nov. 9, 2010

(54) DRIVER DEVICE OF PLASMA DISPLAY PANEL

(75) Inventor: Kazunari Takasugi, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 875 days.

(21) Appl. No.: 11/589,187

(22) Filed: Oct. 30, 2006

(65) Prior Publication Data

US 2007/0146239 A1 Jun. 28, 2007

(30) Foreign Application Priority Data

Oct. 31, 2005 (JP) ..... 2005-316539

(51) Int. Cl.
*G09G 3/28* (2006.01)
*G09G 3/10* (2006.01)

(52) U.S. Cl. ..... 345/60; 315/169.4

(58) Field of Classification Search ..... None
See application file for complete search history.

(56) References Cited

U.S. PATENT DOCUMENTS 5,805,123 A * 9/1998 Satoh et al. ..... 345/60
5,825,099 A * 10/1998 Kwon ..... 307/48
5,886,561 A * 3/1999 Eitan et al. ..... 327/408
6,028,573 A * 2/2000 Orita et al. ..... 345/66
6,057,726 A 5/2000 Sumida
6,850,213 B2 * 2/2005 Marcotte ..... 345/60
7,102,598 B2 * 9/2006 Onozawa et al. ..... 345/61
2006/0285399 A1 * 12/2006 Iwami ..... 365/189.01
2008/0117134 A1 * 5/2008 Choi ..... 345/60

FOREIGN PATENT DOCUMENTS

JP 11-68540 9/1999
JP 2001-51648 2/2001
JP 2004-310108 11/2004

* cited by examiner

*Primary Examiner*—Bipin Shalwala
*Assistant Examiner*—Daniel Bedell
(74) *Attorney, Agent, or Firm*—McGinn IP Law Group, PLLC

(57) ABSTRACT

An output buffer circuit constituted by a totem-pole circuit where two NchMOS transistors are cascade-connected, and the connection point of the two MOS transistors are connected to a data electrode of a display cell, improves the power recovery rate of a driver device of a PDP. A level shift circuit includes a CMOS circuit and drives the output buffer circuit. An electric charge recovery circuit connected to a power supply of the output buffer circuit recovers and reuses electric charges remaining on the data electrode after the discharge of the display cells. A power supply control circuit controls so that the power supply voltage of the level shift circuit is higher than the sum of the power supply voltage of the output buffer circuit and the threshold voltage of the MOS transistors for a period of time during a recovery/reuse cycle of the electric charge recovery circuit.

20 Claims, 12 Drawing Sheets

DRIVER DEVICE OF PLASMA DISPLAY PANEL

FIELD OF THE INVENTION

The present invention relates to a driver device of a PDP (plasma display panel) and particularly to a driver device of a PDP that recovers and reuses electric charges remaining on a data electrode after the discharge of display cells.

BACKGROUND OF THE INVENTION

In general, a PDP is thin, has no flicker and possesses a large display contrast ratio. Further, it can be made into a relatively large screen, has a fast response speed, and is self-luminous. It is capable of emitting light of multiple colors by utilizing fluorescent material. Since PDPs have numerous good characteristics, they have been widely used in the fields of computer-related display devices and color image display in recent years.

FIG. 8 is a block diagram showing an example of a conventional driver device of a PDP according to a related art. In the PDP, a sustain electrode group 42 and a scanning electrode group 53, which are parallel to each other, are provided on one side, and a data electrode group 32 is provided perpendicular to the other electrode groups on the opposing plane. Display cells 22 are formed at the intersections of these groups. The sustain electrodes X correspond to and are provided adjacent to each of the scanning electrodes Y1, Y2, Y3, . . . , Yn (where n is a positive integer) and they are connected in common to each other at one end.

Next, the structures of several kinds of driver circuits for driving the display cells 22 and a control circuit for controlling these driver circuits are described. A data driver 31 that drives data for one line of the data electrode group 32 in order to produce an address discharge in the display cells 22, a sustain electrode driver circuit 40 that causes a common sustain discharge to the sustain electrode group 42 in order to produce a sustain discharge in the display cells 22, and a scanning electrode driver circuit 50 that causes a common sustain discharge to the scanning electrode group 53 are provided. Furthermore, a scanning driver 55 is provided to sequentially scan the scanning electrodes Y1 to Yn of the scanning electrode group 53 in order to produce a selective write discharge in an addressing discharge period. The scanning driver 55 produces a sustain discharge by applying a sustain pulse sent from the scanning electrode driver circuit 50 to its own power supply. A control circuit unit 61 controls every operation of the data driver 31, the sustain electrode driver circuit 40, the scanning electrode driver circuit 50, the scanning driver 55, and a PDP 21. The main part of the control circuit unit 61 comprises a display data control unit 62 and a driving timing control unit 63. The display data control unit 62 has functions of rearranging externally received display data so as to drive the PDP 21, and temporarily storing the rearranged display data row so as to transfer the rearranged data as display data DATA to the data driver 31 at the time of a sequential scanning by the scanning driver 55 at an addressing discharge. The driving timing control unit 63 converts various signals externally received (such as a dot clocks) to internal control signals for driving the PDP 21 and respectively controls each driver and driver circuits.

Here, an address driver circuit that concerns the present invention will be described in detail. The data driver 31 shown in FIG. 8 is generally composed of a plurality of PDP data driver ICs having tens to hundreds of display data output terminals.

The PDP data driver IC (hereinafter "data driver IC") has the function of outputting a data pulse corresponding to display data to a PDP panel. The data driver IC generally has tens to hundreds of terminals for outputting data pulses, which can be either at a high or low level. The data driver IC is composed of a shift register 101, a latch circuit 102, an output control circuit 103, and a level shifter+high breakdown voltage buffer 104 as shown in FIG. 9.

The shift register 101 has the function of transferring display data 106 received from one or multiple display data input terminal(s) using a CLK 105 and storing it. Further, the latch circuit 102 has the function of capturing the display data stored in the shift register 101 into the register via a latch input terminal 107. The display data captured by the latch circuit 102 is outputted from an output terminal 108 as a data pulse signal via the output control circuit 103 and the level shifter+high breakdown voltage buffer 104. The output control circuit 103 generally comprises a control terminal 109 for setting all data pulse outputs of the data driver IC to a high level and a control terminal 110 for setting all the outputs to a low level. Furthermore, the level shifter+high breakdown voltage buffer 104 includes a level shifter for converting the signal level of the output control circuit 103 and supplying it to the output stage.

In recent years, the number of display cells for PDPs has increased greatly as multi-gradation display has become more common and the screens have become larger. The number of lighting cells to be written and the value of the peak current that flows through the scanning electrodes during write discharge have also increased, causing the voltage drop due to the impedances of the electrodes and driver circuit to be large. In order to prevent this and perform a stable write discharge, scanning pulses and data pulses of a higher voltage must be applied. However, this might increase the power consumption of the device.

As a method for reducing power consumption associated with driving a PDP, power recovery (electric charge recovery) is known (refer to Patent Document 1). In this method, electric charges generated during the light emission of the PDP are collected while it is not emitting light and reused at the next light emission. In this case, the electric charges accumulated in the display cells are collected via the output stage of the aforementioned level shifter+high breakdown voltage buffer.

As the output stage of a high breakdown voltage buffer, one constituted by a CMOS circuit and one constituted by a totem-pole circuit where two NchMOS transistors are cascade-connected are known. For instance, the one constituted by a CMOS circuit is disclosed in Patent Document 1, and those constituted by a totem-pole circuit are disclosed in Patent Documents 2 and 3. When power is recovered, electric charges accumulated in display cells are collected through the transistor on the high potential side of the output stage in either circuit structure.

[Patent Document 1]

Japanese Patent Kokai Publication No. JP-P2001-51648A

[Patent Document 2]

Japanese Patent Kokai Publication No. JP-P2004-310108A

[Patent Document 3]

Japanese Patent Kokai Publication No. JP-A-11-68540

SUMMARY OF THE DISCLOSURE

When a case where the output stage (the driver output stage) of the high breakdown voltage buffer is constituted by a CMOS circuit is compared with a case where it is constituted by a totem-pole circuit having two NchMOS transistors cascade-connected, the totem-pole circuit case has an advantage in terms of power recovery rate. In the case of CMOS circuit, the on-resistance of the Pch transistor on the high potential side depends on the power supply voltage VDD2 of the driver output stage, and the on-resistance RON increases as VDD2 decreases, as indicated by "CMOS output" in FIG. 10. On the other hand, in the case of totem-pole circuit, the on-resistance of the Nch transistor on the high potential side does not depend on the power supply voltage VDD2 of the driver output stage, as indicated by "N-N output" in FIG. 10. Since the power supply voltage VDD2 of the driver output stage fluctuates during the power recovery of the PDP, using a totem-pole circuit for the driver output stage has an advantage.

However, the on-resistance RON of the Nch transistor on the high potential side of the totem-pole circuit is high in the region where the current is low, as shown in FIG. 10. Even when the W size of the Nch transistor on the high potential side is increased in order to improve the current capability, the on-resistance in the low current region stays high and does not get low (does not improve), as shown in FIG. 11, since the threshold voltage (VT) of the transistor is unchanged.

The reason why the on-resistance is high in the low current region is that little current flows in a region where the drain voltage is equal to or lower than the threshold voltage VT of the Nch transistor (the drain-source voltage VDS=VDD2−VOUT<VT) as indicated in FIG. 12 since the gate voltage VGS and the drain voltage VDS of the Nch transistor on the high potential side become equal. Further, when the drain voltage is low, so is the gate voltage, allowing little current to flow.

When electric charges accumulated in display cells are collected and reused in a PDP, the current flowing through the transistor on the high potential side is very small. Therefore, the power recovery rate has been improved very little because of the high on-resistance in the low current region of the transistor, despite the fact that there has been a demand for a method for improving the power recovery rate in response to the increase in the number of display cells due to multi-gradation displays and larger screens.

Therefore, there is much to be desired in the art.

According to a first aspect of the present invention, there is provided a driver device of a PDP. The driver device comprises an output buffer circuit composed of two cascade-connected MOS transistors of the same conductivity type wherein a connection point of the two MOS transistors is connected to a data electrode of a display cell; a level shift circuit that drives the output buffer circuit; an electric charge recovery circuit; connected to a power supply terminal of the output buffer circuit, that recovers for reusing electric charges remaining on the data electrode after discharge of the display cell; and a power supply control circuit that controls so that the power supply voltage of the level shift circuit is higher than the sum of the power supply voltage of the output buffer circuit and the threshold voltage of the MOS transistors for at least a period of time during a recovery/reuse cycle of the electric charge recovery circuit.

According to a second aspect, the power supply control circuit comprises:

a power supply unit that outputs a predetermined positive voltage, a first diode whose anode is connected to an output of the power supply unit and whose cathode is connected to a power supply terminal of the level shift circuit, and a second diode whose anode is connected to a power supply terminal of the output buffer circuit and whose cathode is connected to the power supply terminal of the level shift circuit.

According to a third aspect, the power supply control circuit comprises:

a power supply unit that outputs a predetermined positive voltage, a first switch element that switches the connection between an output of the power supply unit and a power supply terminal of the level shift circuit ON and OFF, and a second switch element that switches the connection between a power supply terminal of the output buffer circuit and a power supply terminal of the level shift circuit ON and OFF, provided that the first switch element is ON during a first period when electric charges accumulated in the electric charge recovery circuit are supplied to the data electrode, the first and second switches are OFF during a second period when electric charges remaining on the data electrode are collected in the electric charge recovery circuit, and it is controlled so that the first and second switches are never ON simultaneously.

According to a fourth aspect, the power supply unit outputs a variable voltage higher than the predetermined positive voltage instead of the predetermined positive voltage for at least a part of the first and second periods.

According to a fifth aspect, a MOS transistor on a high potential side of the output buffer circuit turns ON and the electric charge recovery circuit is connected to the data electrode via the MOS transistor that has turned ON during the period of time.

According to a sixth aspect, the level shift circuit is constituted by a CMOS circuit.

According to a seventh aspect, an output of the level shift circuit is connected to a gate of a MOS transistor on a high potential side of the output buffer circuit, comprising a Zener diode whose cathode is connected to the gate and whose anode is connected to a source of the MOS transistor.

According to an eighth aspect, there is provided a display apparatus comprising the driver device of a PDP as mentioned in the first to seventh aspects, and a PDP having display cells driven by the driver device.

The meritorious effects of the present invention are summarized as follows.

According to the present invention, since the on-resistance in the low current region of an Nch transistor on the high potential side can be suppressed low for a period of time during a recovery/reuse cycle, the power recovery rate is improved and the power consumption of a driver device can be reduced. Furthermore, since the generation of heat by the driver device can be suppressed, the heat dissipation mechanism of a display apparatus comprising this driver device can be simplified.

BRIEF DESCRIPTIONS OF THE DRAWINGS

PREFERRED EMBODIMENTS OF THE INVENTION

Figure 1:
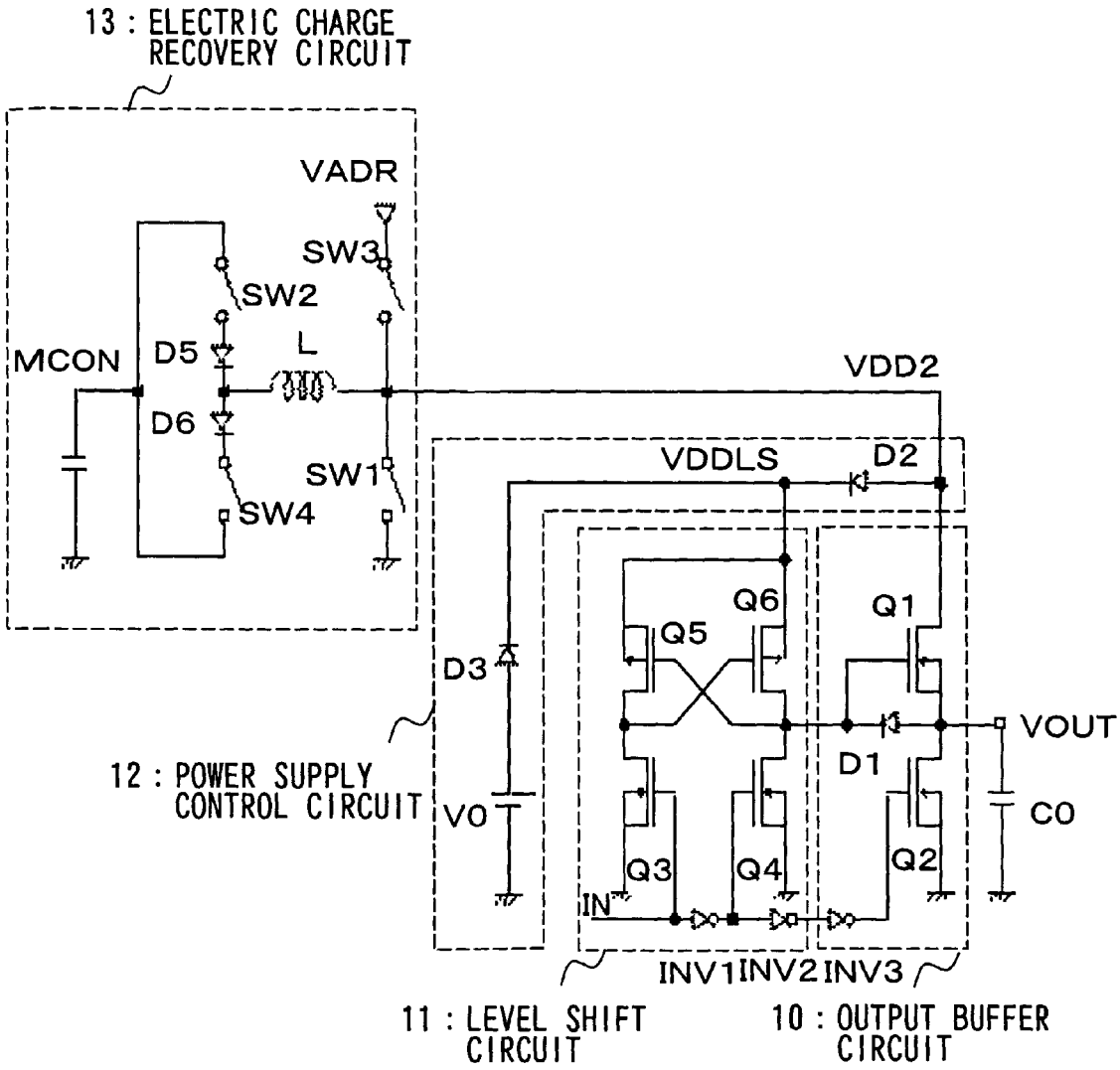
FIG. 1 is a circuit diagram illustrating the structure of a driver device of a PDP relating to a first embodiment of the present invention.

A driver device of a PDP relating to an embodiment of the present invention is constituted by a totem-pole circuit where two NchMOS transistors (Q1 and Q2 in FIG. 1) are cascade-connected and comprises an output buffer circuit (10 in FIG. 1) that connects the connection point (VOUT in FIG. 1) between the two MOS transistors to the data electrode of a display cell (C0 in FIG. 1). It also comprises a level shift circuit (11 in FIG. 1) constituted by a CMOS circuit that drives the output buffer circuit and an electric charge recovery circuit (13 in FIG. 1), connected to a power supply terminal (VDD2 in FIG. 1) of the output buffer circuit, for recovering and reusing electric charges remaining on the data electrode after the discharge of the display cell. It further comprises a power supply control circuit (12 in FIG. 1) for controlling so that the power supply voltage of the level shift circuit is higher than the sum of the power supply voltage of the output buffer circuit and the threshold voltage of the MOS transistors for a period of time during a recovery/reuse cycle of the electric charge recovery circuit.

In the driver device structured as above, the power supply of the output buffer circuit and the power supply of the level shift circuit in the preceding stage of the output buffer circuit are separable, and the gate voltage of the Nch transistor on the high potential side of the output buffer circuit can be controlled without affecting the power supply of the output buffer circuit. Further, a high voltage not lower than the threshold voltage of the Nch transistor is applied to the power supply voltage of the level shift circuit from the power supply voltage of the output buffer circuit for at least a period of time during a recovery/reuse cycle of the electric charge recovery circuit. As a result, it becomes possible to turn on the Nch transistor on the high potential side even in a region where the drain-source voltage is not higher than the threshold voltage, improving the on-resistance in the low current region and the power recovery rate.

EMBODIMENT 1

FIG. 1 is a circuit diagram illustrating the structure of a driver device of a PDP relating to a first embodiment of the present invention. In FIG. 1, the driver device comprises an output buffer circuit 10, a level shift circuit 11, a power supply control circuit 12, and an electric charge recovery circuit 13.

The output buffer circuit 10 comprises Nch transistors Q1 and Q2, a Zener diode D1, and an inverter circuit INV3. The drain of the Nch transistor Q1 is connected to a power supply VDD2, the source is connected to the drain of the Nch transistor Q2, an anode of a Zener diode D1 and an output terminal VOUT, and the gate is connected to a cathode of the Zener diode D1 and an output of the level shift circuit 11. The gate of the Nch transistor Q2 is connected to an output of an inverter circuit INV3, and the source is grounded. The Nch transistors Q1 and Q2 constitute a totem-pole circuit. A data electrode C0 of a display cell is connected to the output terminal VOUT, which is driven by the output buffer circuit 10.

The level shift circuit 11 is constituted by a CMOS circuit comprising Nch transistors Q3 and Q4, Pch transistors Q5 and Q6, and inverter circuits INV1 and INV2. The drain of the Nch transistor Q3 is connected to the drain of the Pch transistor Q5 and the gate of the Pch transistor Q6, the source is grounded, and data IN is supplied to the gate. The drain of the Nch transistor Q4 is connected to the drain of the Pch transistor Q6 and the gate of the Pch transistor Q5, forming an output of the level shift circuit 11. Further, the source of the Nch transistor Q4 is grounded and data IN inverted by the inverter circuit INV1 is supplied to the gate. The sources of the Pch transistors Q5 and Q6 are connected to a power supply VDDLS. Further, the output of the inverter circuit INV1 is fed to an inverter circuit INV3 via an inverter circuit INV2.

The power supply control circuit 12 comprises a power supply unit V0, and diodes D2 and D3. The power supply unit V0 generates a predetermined positive voltage on one end and supplies power to the power supply VDDLS of the level shift circuit 11 via the diode D3 whose anode is connected to the power supply unit V0. The anode of the diode D2 is connected to the power supply VDD2 and the cathode is connected to the power supply VDDLS.

The electric charge recovery circuit 13 comprises switches SW1, SW2, SW3, and SW4, an inductor L, diodes D5 and D6, and a condenser MCON. One end (terminal) of the switch SW1 is grounded and the other end (terminal) is connected to a power supply node VDD2 as an input/output of the electric charge recovery circuit 13. One end of the switch SW3 is connected to a high voltage power supply VADR and the other end is connected to the power supply node VDD2. One end of the inductor L is connected to the cathode of the diode D5 and the anode of the diode D6, and the other end is connected to the power supply node VDD2. The anode of the diode D5 is connected to one end of the condenser MCON via the switch SW2. The cathode of the diode D6 is connected to the same end (terminal) of the condenser MCON via the switch SW4. The other end of the condenser MCON is grounded. The electric charge recovery circuit 13 structured as above opens/closes the switches SW1, SW2, SW3, and SW4 on a time-division basis according to cycles of power supply, recovery, and reuse as described later. By opening/closing these switches, power is supplied to the data electrode C0 of the display cell from the high voltage power supply VADR via the output buffer circuit 10, and electric charges remaining on the data electrode C0 after the discharge of the display cell are collected for recovery in the condenser MCON and reused.

In the driver device structured as above, when the data IN is at a high level, the Nch transistor Q3 and the Pch transistor Q6 turn on and the potential of the power supply VDDLS is supplied to the gate of the Nch transistor Q1. Therefore, the Nch transistor Q1 is controlled to turn on. Meanwhile, the Nch transistor Q4, the Pch transistor Q5, and the Nch transistor Q2 are off due to the inverter INV1 disposed between the gates of the Pch transistors Q3 and Q4. Note that the Nch transistor Q1 is off when the data IN is at a low level, however, since this case does not concern the present invention, only the case where the data IN is at a high level will be described below.

Figure 2:
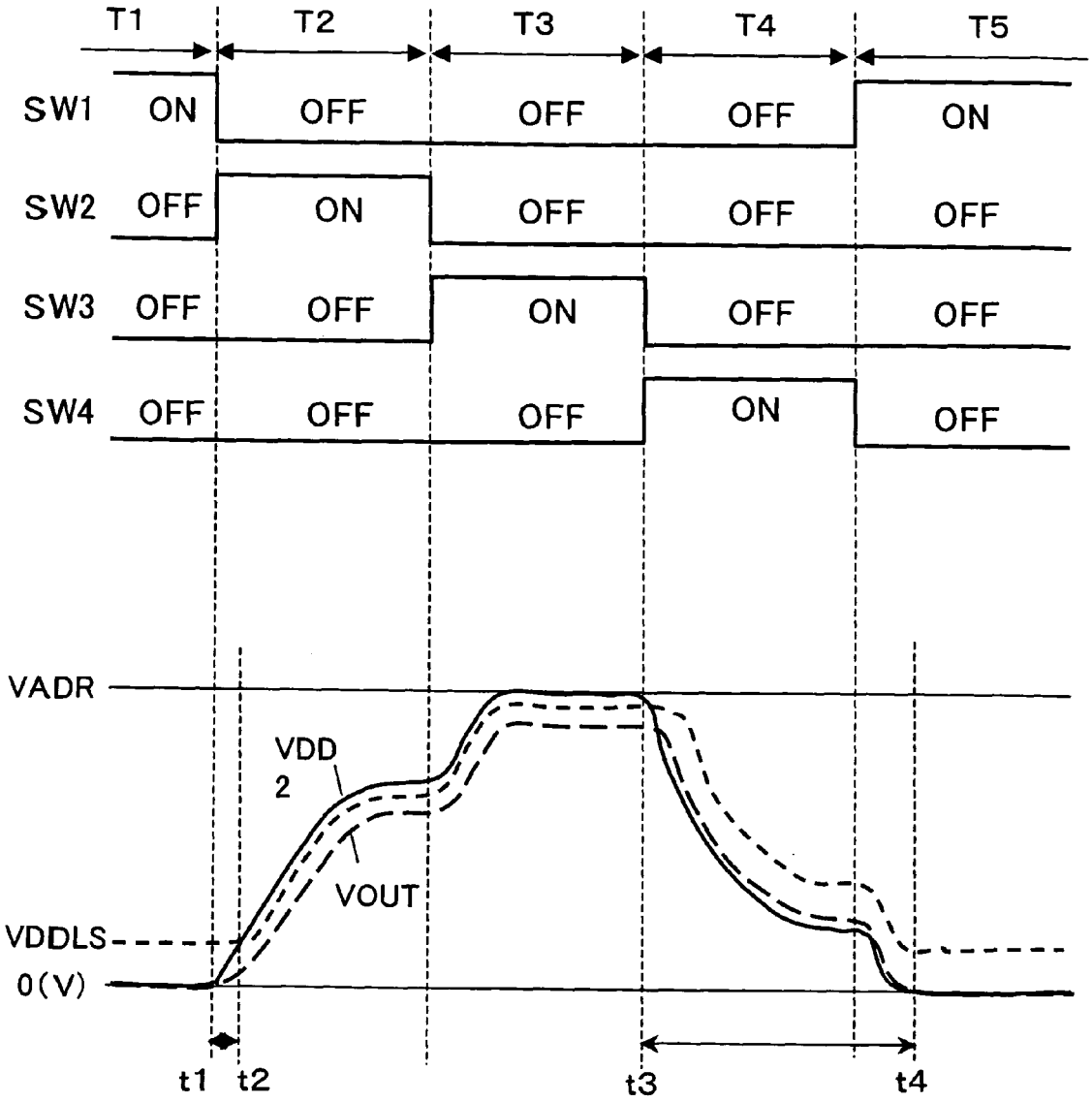
FIG. 2 is a drawing showing the operation waveform of each part of the driver device of a PDP relating to the first embodiment of the present invention.

Next, the operation of the driver device structured as above will be explained. FIG. 2 is a drawing showing the operation waveform of each part of the driver device of a PDP relating to the first embodiment of the present invention. In FIG. 2, a phase T1 (an initial state) and phases T2, T3, T4, and T5 that correspond to one cycle from the rising to the falling of the voltage of the output terminal VOUT are shown.

T1 is the initial state in which SW1=ON, SW2=OFF, SW3=OFF, and SW4=OFF. The voltage of the power supply VDD2 is 0V, and it is preferable that the voltage of the power supply VDDLS be not lower than the threshold voltage (VT) of the Nch transistors and not higher than the breakdown voltage of the Zener diode D1 (for instance 5V) placed in the output buffer circuit. In this state, electric charges are accumulated in the condenser MCON.

T2 corresponds to a reuse phase of the electric charge recovery circuit and SW1=OFF and SW2=ON during this phase. The electric charges accumulated in the condenser MCON migrate to the data electrode C0 of the display cell through the switch SW2, the diode D5, the inductor L, the power supply (node) VDD2, and the Nch transistor Q1. As a result, the potential of the output terminal VOUT increases. When the potential of the power supply VDD2 becomes higher than that of the power supply VDDLS, the potential of the power supply VDDLS increases, following the potential of the power supply VDD2 via the diode D2 disposed between the VDD2 node and the VDDLS node.

In T3, SW2=OFF and SW3=ON. The voltage of the high voltage power supply VADR is supplied to the data electrode C0 of the display cell via the switch SW3, which has turned ON, and the Nch transistor Q1. The potential of the power supply VDD2 further increases up to the potential of the high voltage power supply VADR and saturates thereat.

The phase T4 corresponds to a recovery phase of the electric charge recovery circuit, and SW3=OFF and SW4=ON during this phase. The electric charges accumulated in the data electrode C0 of the display cell how migrate to the condenser MCON through the Nch transistor Q1, the inductor L, the diode D6, and the switch SW4. Since the level shift circuit 11 is constituted by the CMOS circuit and VDD2 falls down quicher than VDDLS to hold VDD2<VDDLS during the phase T4, no current flows from the power supply VDDLS having a high potential across the diode D2 in the reverse direction and the higher potential relationship of the power supply VDDLS over VDD2 is held. Further, when the potential of the output terminal VOUT drops and the amount of the decrease is equal to or more than the breakdown voltage of the Zener diode D1 (the Zener voltage), the potential of the power supply VDDLS starts to drop along with decrease in VOUT. (See FIG. 2)

This is due to the presence of the Zener diode D1 between VOUT (anode) and the gate of the transistor Q1 (cathode).

In the phase T5, SW4=OFF and SW1=ON. Excess charges (potential) are discharged by the "ON" switch SW1. Further, VDD2=VOUT=0V holds here. This state is identical to the state in the initial phase T1, and electric charges are accumulated in the condenser MCON.

The phases T2 to T5 described above are repeated.

During a period from timing t1 when T1 switches to T2 to timing t2 when the potential of the power supply VDD2 becomes nearly identical to the potential of the power supply VDDLS (i.e., crosses VDDLS), the Nch transistor Q1 is in an ON state. Therefore, the on-resistance of the output of the output buffer circuit 10 is low when it starts to rise.

Figure 3:
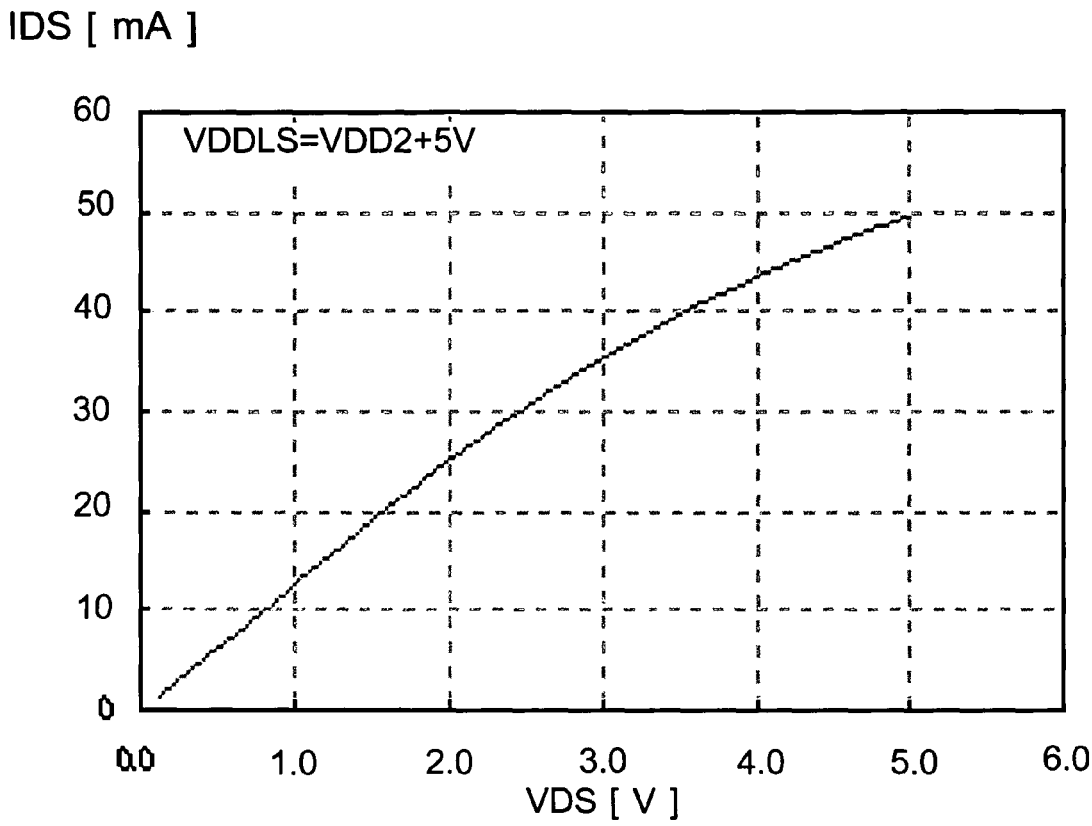
FIG. 3 is a drawing showing an example of the voltage-current characteristics of a Nch transistor Q1.
Figure 12:
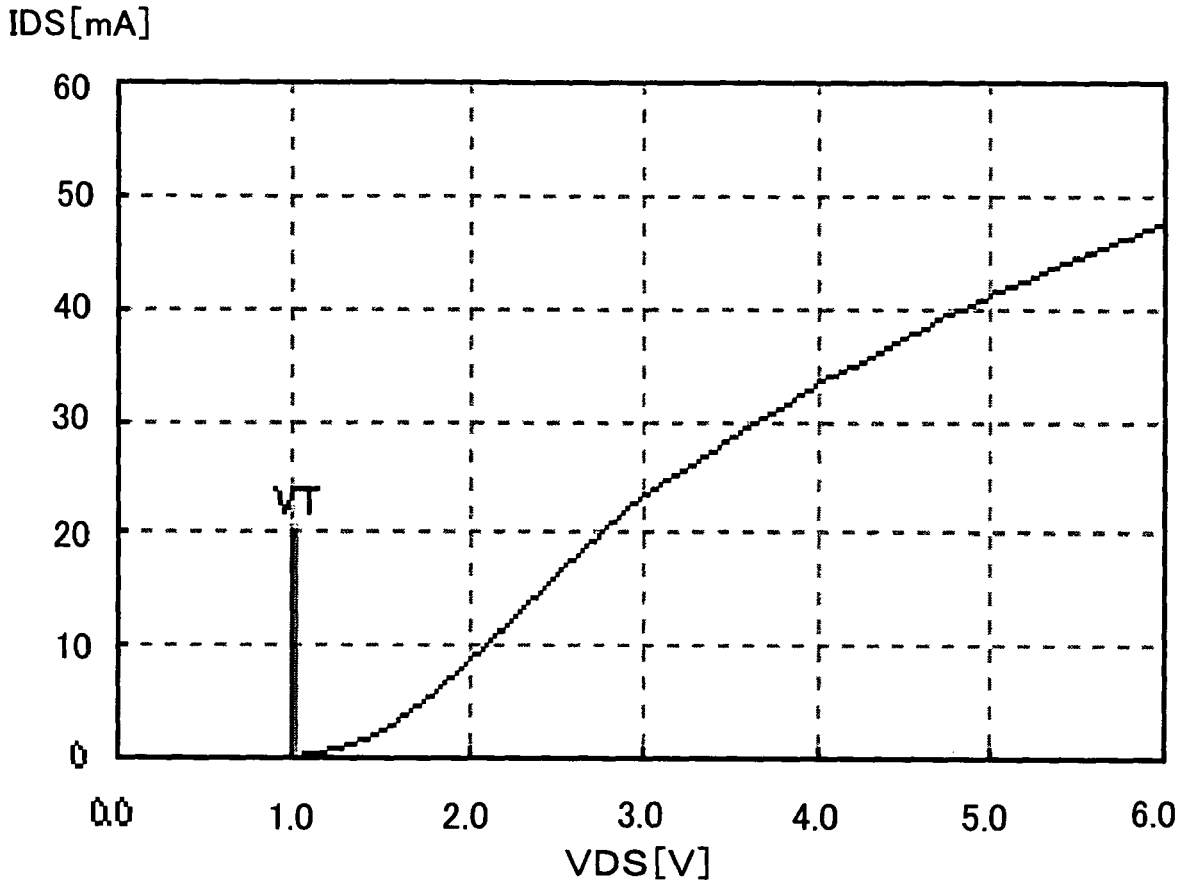
FIG. 12 is a drawing showing an example of the voltage-current characteristics of a general Nch transistor according to the analysis by the present invention.

Furthermore, during a period from timing t3 at which T3 switches to T4 to timing t4 at which the potential of the power supply VDD2 becomes nearly 0V, a voltage (potential difference) not lower than the threshold voltage of the Nch transistor Q1 is supplied between the gate and the source of the Nch transistor Q1 across the Zener diode D1. In this state, assuming the Zener voltage of the Zener diode D1 is 5V, the potential of the power supply node VDDLS is at a value obtained by adding 5V to the potential of the power supply VDD2. In this case, even when the drain-source voltage VDS is low, a sufficient amount of a drain current IDS flows as shown in FIG. 3, unlike the case in FIG. 12. In FIG. 3, the drain current IDS is substantially higher as compared to the case of FIG. 12. That is, the IDS goes up proportional to VDS starting from 0V up to 1V and further of the VDS in FIG. 3.

Figure 4:
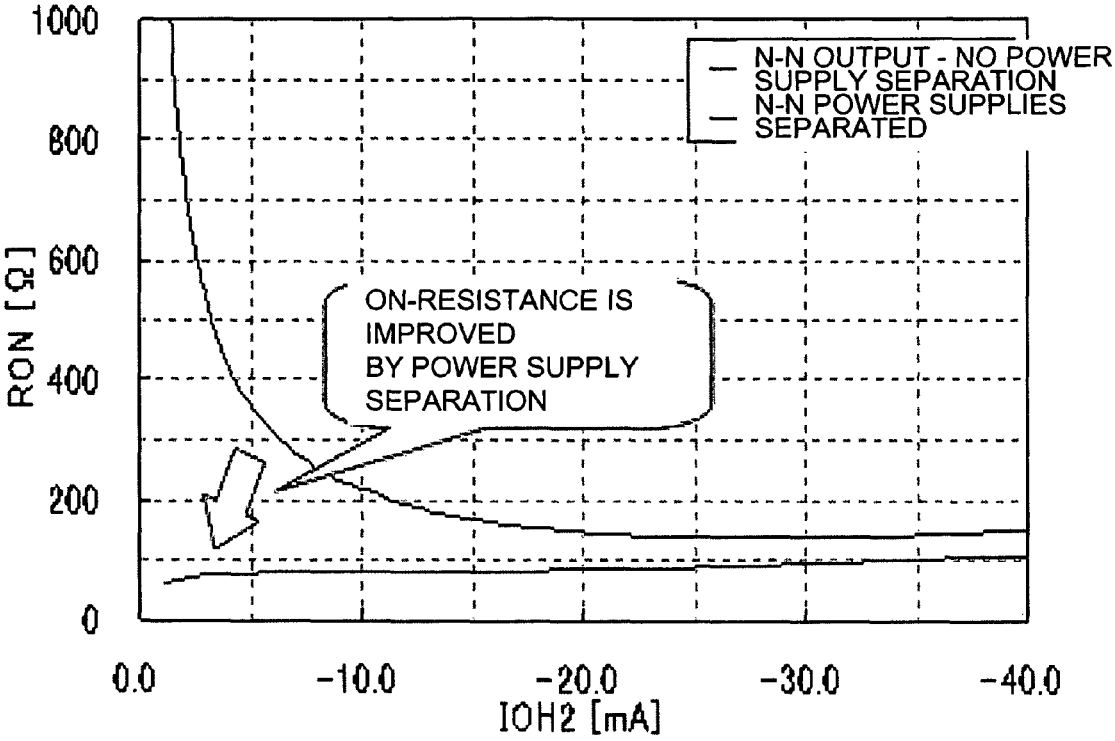
FIG. 4 is a drawing showing an example of the on-resistance characteristics of the Nch transistor Q1.
Figure 11:
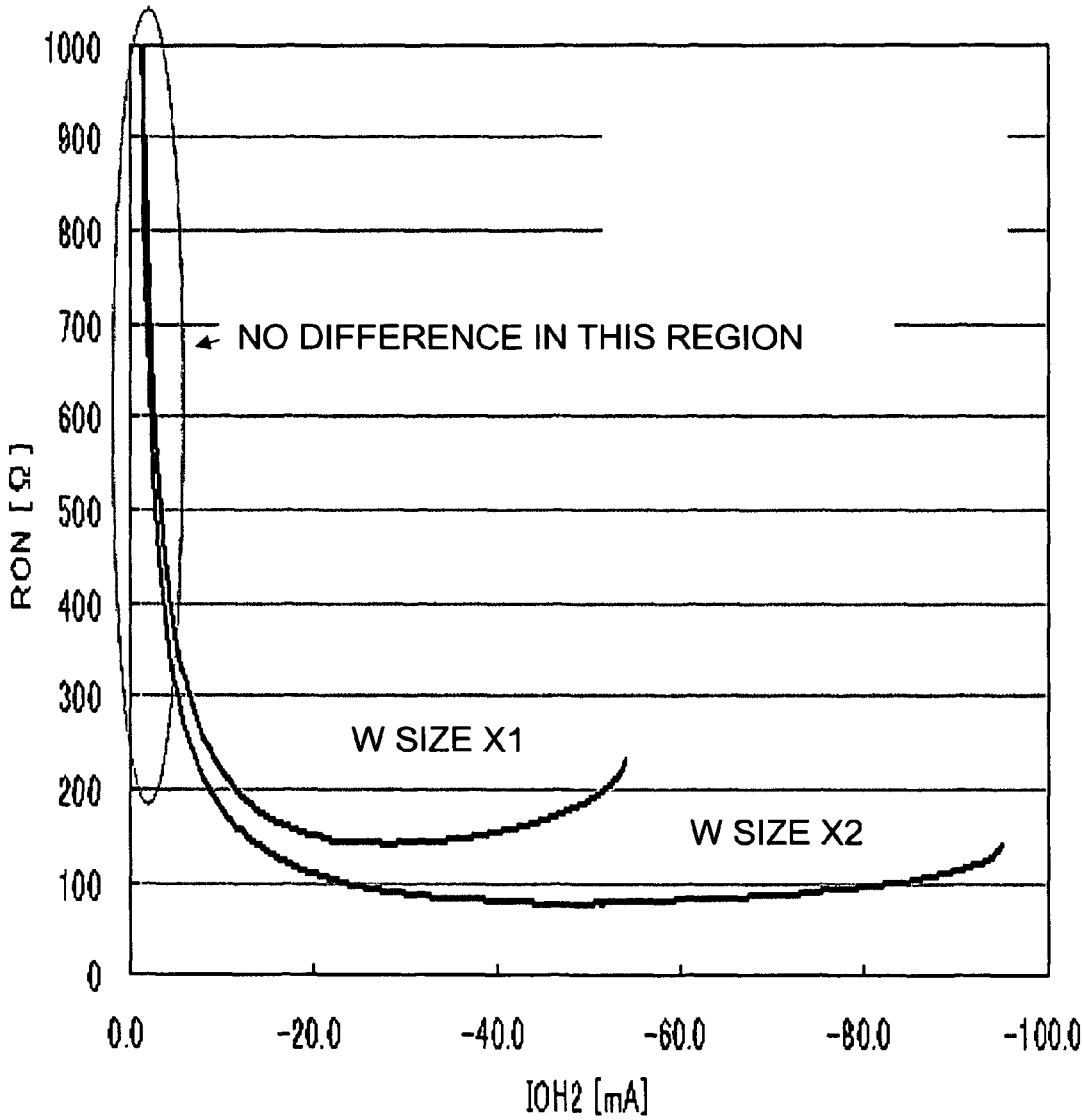
FIG. 11 is a drawing showing an example of the on-resistance characteristics in the low current region of an Nch transistor according to the analysis by the present invention.

Further, as shown in FIG. 4, by separating the power supply VDDLS from the power supply VDD2 and setting the potential of the power supply VDDLS higher than that of the power supply VDD2, the on-resistance (RON) of the Nch transistor Q1 is significantly lowered at the low current region of the transistor Q1 (the leftmost region in FIG. 4 as compared to FIG. 11).

As described above, the on-resistance in the low current region of the Nch transistor Q1 can be suppressed for a period of time during the recovery/reuse cycle. Therefore, power loss at the Nch transistor Q1 is reduced and the power recovery rate is improved, decreasing the power consumption of the driver device.

EMBODIMENT 2

Figure 5:
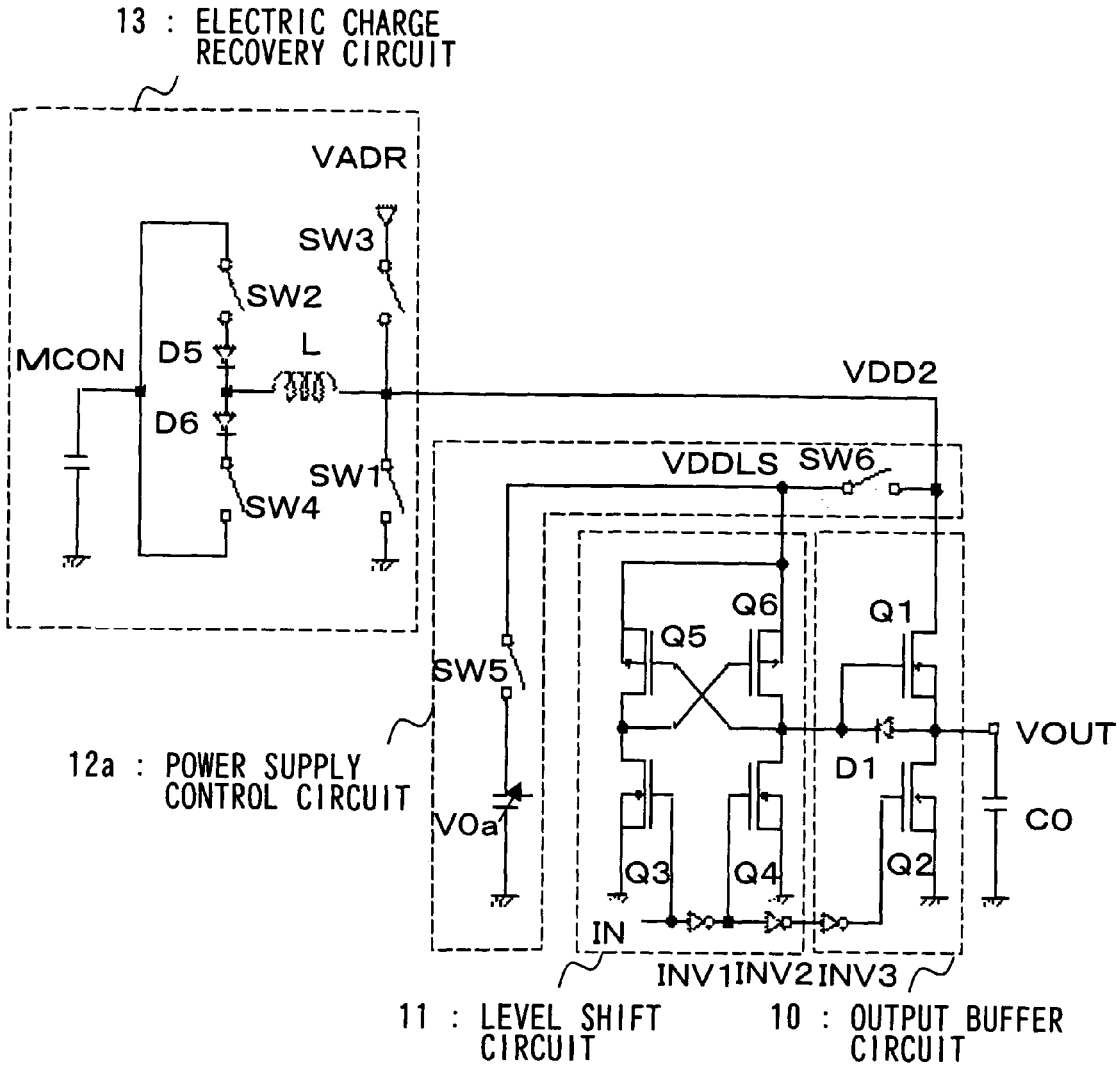
FIG. 5 is a circuit diagram illustrating the structure of a driver device of a PDP relating to a second embodiment of the present invention.

FIG. 5 is a circuit diagram illustrating the structure of a driver device of a PDP relating to a second embodiment of the present invention. In FIG. 5, the same symbols as those in FIG. 1 represent the same things, thus explanations of them will be omitted. In FIG. 5, a power supply control circuit 12*a* comprises a power supply unit V0*a*, and switches SW5 and SW6. The power supply unit V0*a* generates a fixed or variable positive voltage on one end and supplies power to the power supply (node) VDDLS of the level shift circuit 11 via the switch SW5. Further, the switch SW6 is provided between the power supply VDD2 and the power supply VDDLS. The switches SW5 and SW6 are ON/OFF controlled by a control circuit (not shown in the drawing) in the timing described below.

Figure 6:
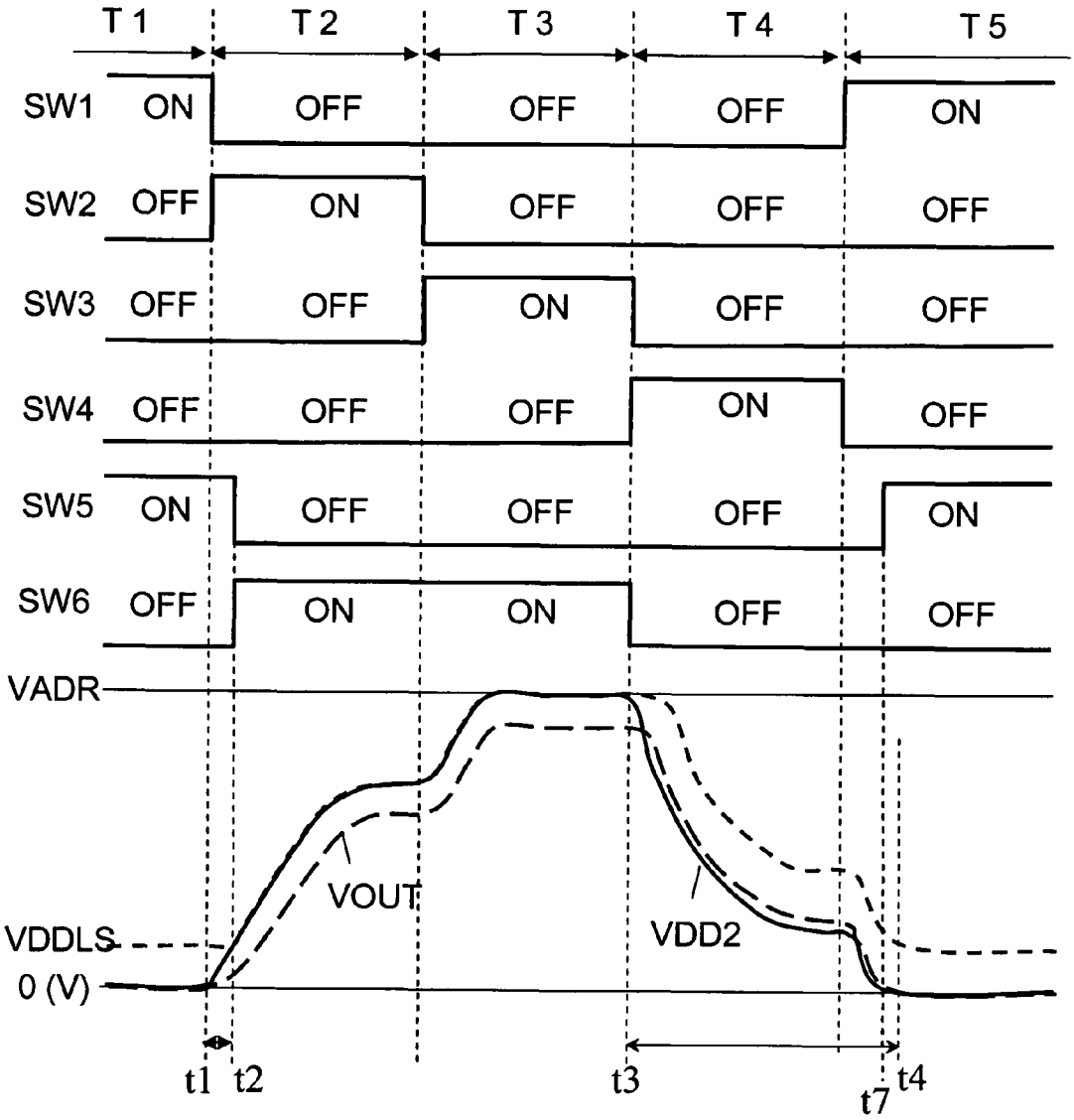
FIG. 6 is a drawing showing an operation waveform of each part of the driver device of a PDP relating to the second embodiment of the present invention.

Next, an operation of the driver device of a PDP structured as above will be explained. FIG. 6 is a drawing showing the operation waveform of each part of the driver device of a PDP relating to the second embodiment of the present invention, and it shows the case where the power supply unit V0*a* generates a fixed positive voltage (V0*a*) on one end. The phases T1 to T5 are the same as those in FIG. 2 as far as the switches SW1 through SW4 are concerned, thus explanations of them will be omitted. The switch SW5 is controlled to change to OFF from ON at the timing t2 and is controlled to change back to ON from OFF at timing t7 when a dropped voltage of the power supply VDDLS becomes the same as the fixed voltage (V0*a*) generated by the power supply unit V0*a*. Meanwhile, the switch SW6 is controlled to change to ON from OFF at the timing t2 and is controlled to change back to OFF from ON at the timing t3. Therefore, the potential of the power supply VDDLS is the same as that of the power supply VDD2 during the period from the timing t2 to the timing t3.

In the driver device that operates as described above, it is controlled so that the on-resistance of the Nch transistor Q1 is low during the period between the timings t1 and t2 and the period between the timings t3 and t4 as in Embodiment 1.

Figure 7:
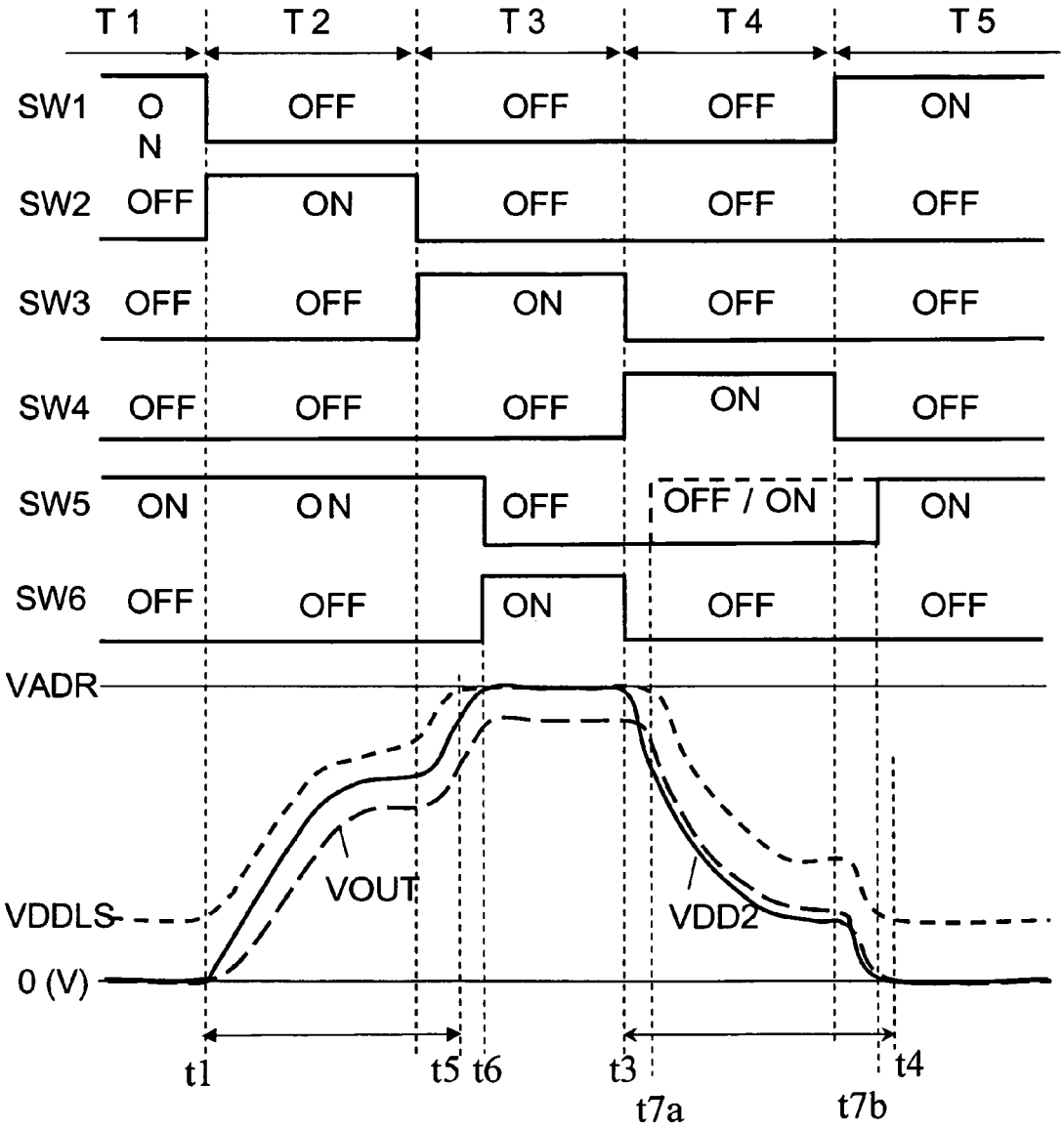
FIG. 7 is a drawing showing another operation waveform of each part of the driver device of a PDP relating to the second embodiment of the present invention.
Figure 8:
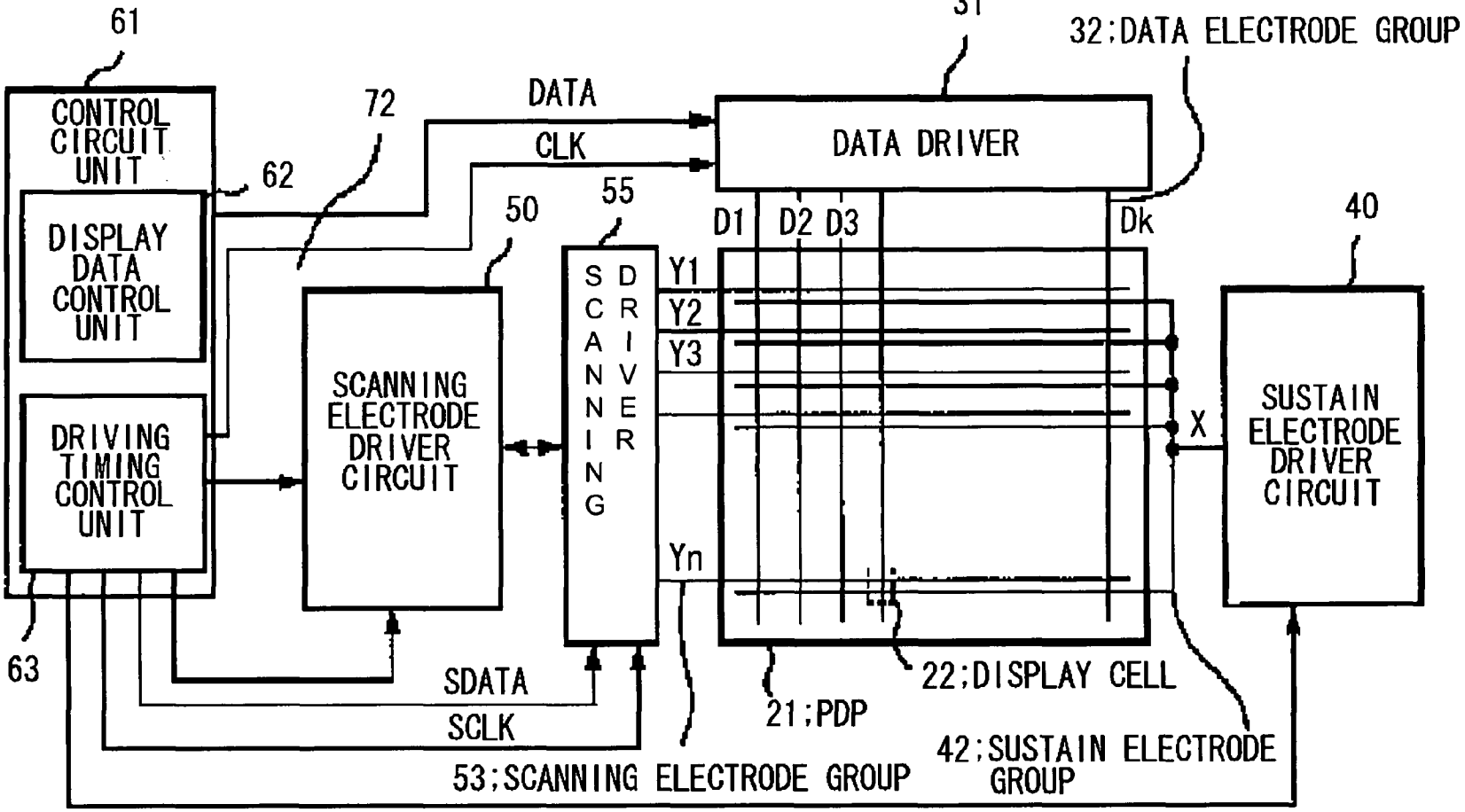
FIG. 8 RELATED ART
FIG. 8 is a block diagram showing an example of a driver device of a PDP according to the related art.
Figure 9:
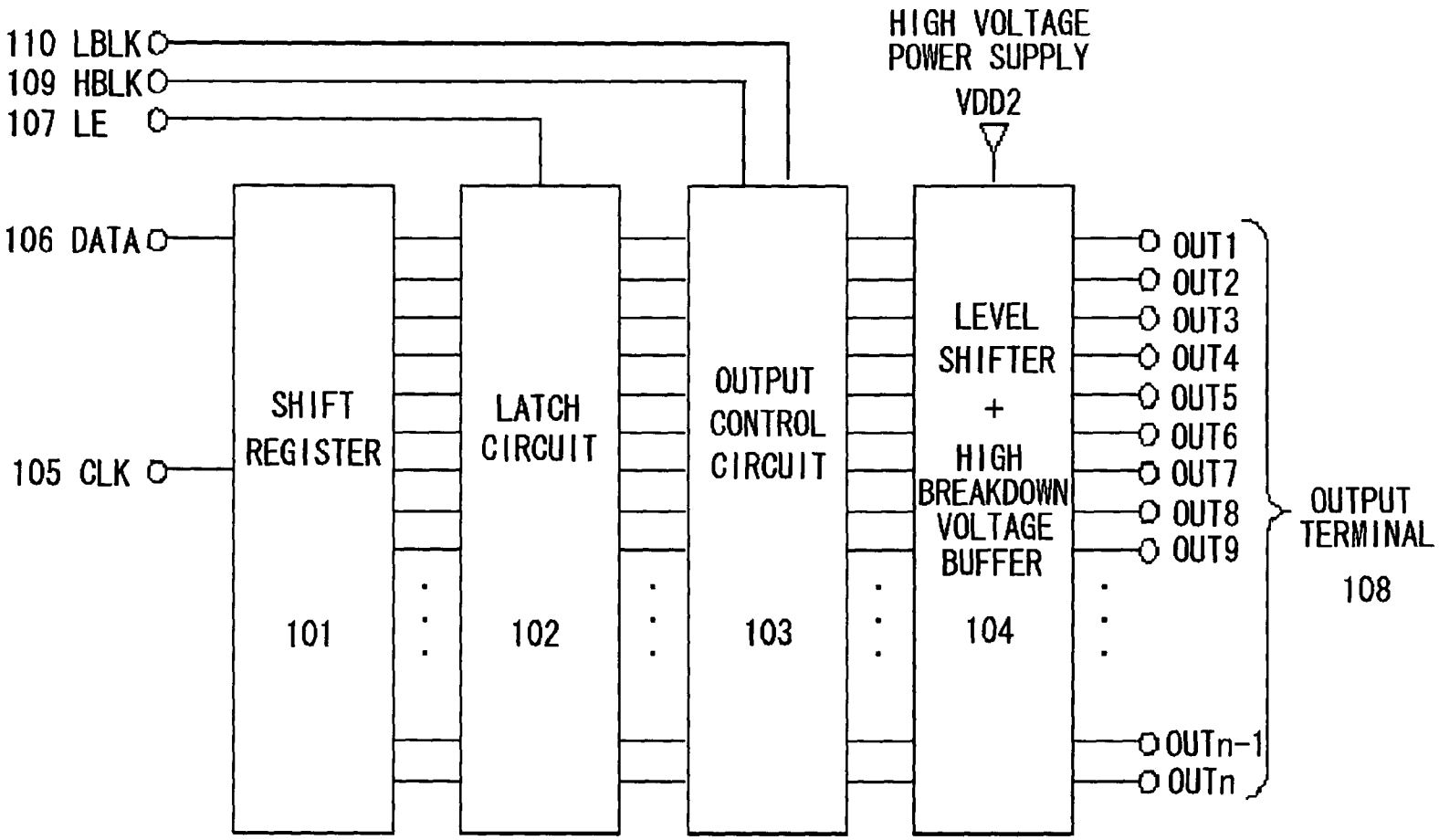
FIG. 9 RELATED ART
FIG. 9 is a block diagram illustrating the structure of a data driver IC according to the related art.
Figure 10:
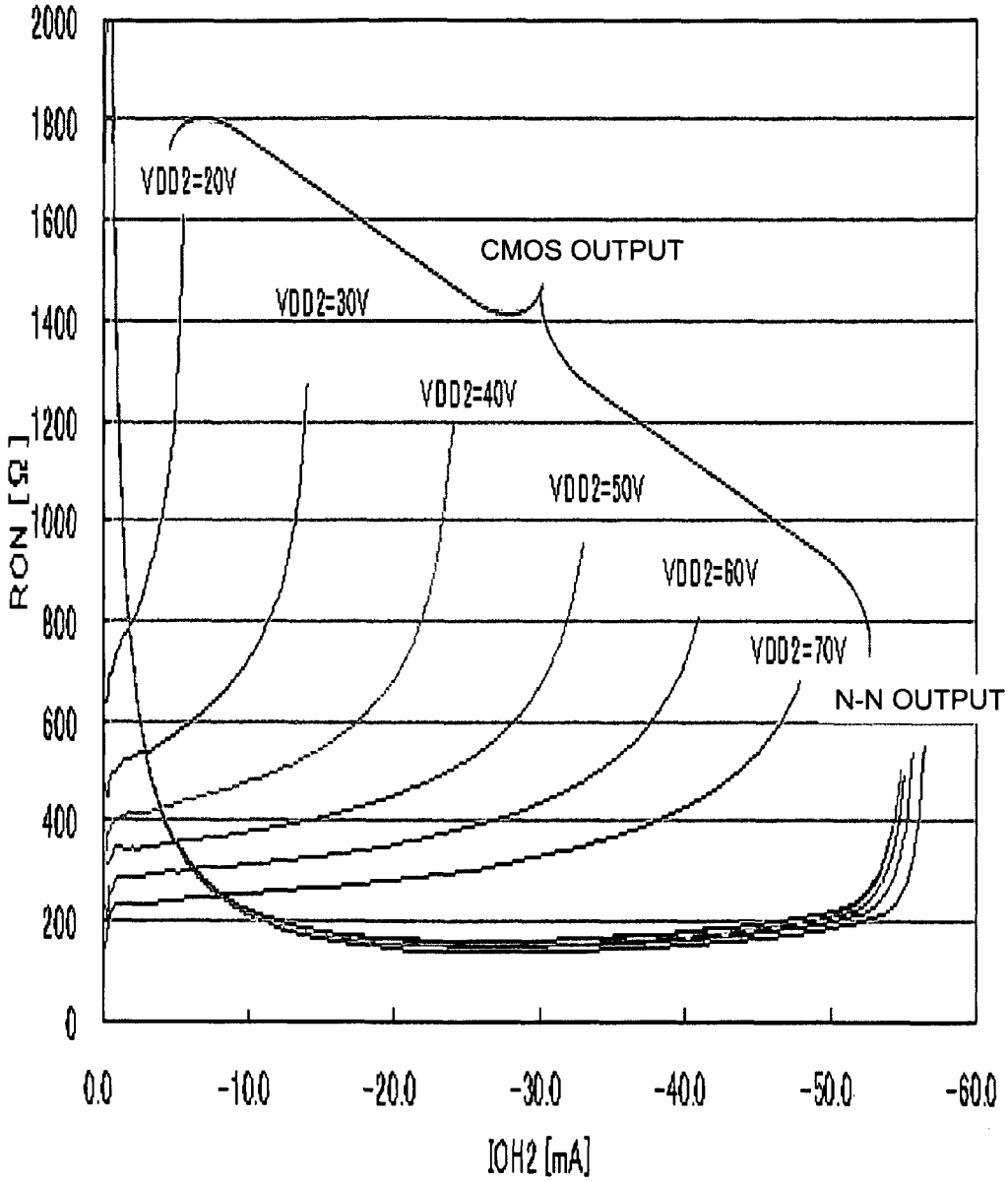
FIG. 10 is a drawing showing an example of the on-resistance characteristics of output circuits composed of a CMOS circuit and a totem-pole circuit according to the analysis by the present invention.

Next, another operation of the driver device structured identically will be described. FIG. 7 is a drawing showing the operation waveform of each part of the driver device of a PDP relating to the second embodiment of the present invention, and it shows the case where the power supply unit V0*a* generates a variable positive voltage on one end. The phases T1 to T5 are the same as those in FIG. 2 as far as the switches SW1 through SW4 are concerned, thus explanations of them will be omitted. The switch SW5 is controlled to change to OFF from ON at timing t6 at which the potential of the power supply VDD2 (solid line) almost reaches the potential of the high voltage power supply VADR. The power supply unit V0*a* generates and varies the voltage so that it is higher than the potential of the power supply VDD2 during a period between the timings t1 and t6. Further, the switch SW5 is controlled to change to ON from OFF sometime between a time at which the voltage of the power supply VDD2 starts to drop and a time at which it nearly becomes approximately 0V, i.e., sometime between timings t7*a* and t7*b*. The power supply unit V0*a* generates and varies the voltage so that the variable voltage is higher than the potential of the power supply VDD2 during a period between a time at which the switch SW5 turns ON and the timing t4. Meanwhile, the switch SW6 is controlled to change to ON from OFF at the timing t6, and to OFF from ON at the timing t3. Therefore, the potential of the power supply VDDLS is the same as that of the power supply VDD2 during the period from the timing t6 to the timing t3.

In the driver device that operates as described above, the on-resistance of the Nch transistor Q1 is low during a period between the timing t1 and timing t5 when the potential of the power supply VDDLS almost reaches the potential of the high voltage power supply VADR and a period between the timings t3 and t4. In this case, the on-resistance is low during a longer period of time (between the timings t1 and t5) than the period between the timings t1 and t2 in FIG. 6. As described above, the potential of the power supply VDDLS becomes controllable by having the power supply unit V0*a* generate a variable voltage. As a result, the on-resistance of the Nch transistor Q1 can be more freely controlled during a long period of time starting from the initial state until an extended period of time.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A driver device of a PDP (plasma display panel) comprising:

an output buffer circuit comprising two cascade-connected MOS transistors of a same conductivity type wherein a connection point of said two MOS transistors is connected to a data electrode of a display cell;

a level shift circuit that drives said output buffer circuit;

an electric charge recovery circuit, connected to a power supply terminal of said output buffer circuit, that recovers for reusing electric charges remaining on the data electrode after a discharge of said display cell; and a power supply control circuit connected in parallel with said output buffer circuit between said power supply terminal of said output buffer circuit and a power supply terminal of said level shift circuit that controls so that a power supply voltage of said level shift circuit is higher than a sum of a power supply voltage of said output buffer circuit and a threshold voltage of said MOS transistors for at least a period of time during a recovery/reuse cycle period of said electric charge recovery circuit.

2. The driver device of a PDP as defined in claim 1, wherein said power supply control circuit comprises:

a power supply unit that outputs a predetermined positive voltage;

a first diode whose anode is connected to an output of said power supply unit and whose cathode is connected to a power supply terminal of said level shift circuit; and a second diode whose anode is connected to a power supply terminal of said output buffer circuit and whose cathode is connected to the power supply terminal of said level shift circuit.

3. The driver device of a PDP as defined in claim 1, wherein said power supply control circuit comprises:

a power supply unit that outputs a predetermined positive voltage;

a first switch element that switches the connection between an output of said power supply unit and a power supply terminal of said level shift circuit ON and OFF; and a second switch element that switches the connection between a power supply terminal of said output buffer circuit and a power supply terminal of said level shift circuit ON and OFF, wherein said first switch element is ON during a first period when electric charges accumulated in said electric charge recovery circuit are supplied to said data electrode, said first and second switches are OFF during a second period when electric charges remaining on said data electrode are collected in said electric charge recovery circuit, and it is controlled so that said first and second switches are never ON simultaneously.

4. The driver device of a PDP as defined in claim 3, wherein said power supply unit outputs a variable voltage higher than said predetermined positive voltage instead of said predetermined positive voltage for at least a part of said first and second periods.

5. The driver device of a PDP as defined in claim 1, wherein a MOS transistor on a high potential side of said output buffer circuit turns ON and said electric charge recovery circuit is connected to said data electrode via the MOS transistor that has turned ON during said period of time.

6. The driver device of a PDP as defined in claim 1 wherein said level shift circuit comprises a CMOS circuit.

7. The driver device of a PDP as defined in claim 1, wherein an output of said level shift circuit is connected to a gate of a MOS transistor on a high potential side of said output buffer circuit, comprising a Zener diode whose cathode is connected to said gate and whose anode is connected to a source of said MOS transistor.

8. A display apparatus comprising the driver device of a PDP as defined in claim 1 and a PDP having display cells driven by said driver device.

9. The driver device of a PDP as defined in claim 6, wherein said level shift circuit comprises:

first and second cascade-connected MOS transistors of different conductivity types;

third and fourth cascade-connected MOS transistors, where said first and third MOS transistors are of a same conductivity type as each other, and said second and fourth MOS transistors are of a same conductivity type as each other;

an input node connected to a gate of said first MOS transistor and through an inverter to a gate of said third MOS transistor;

a power supply node commonly connected to drains of said second and fourth MOS transistors;

a node connected to a drain of said first MOS transistor, a source of said second MOS transistor, and a gate of said fourth MOS transistor; and an output node connected to a drain of said third MOS transistor, a source of said fourth MOS transistor, and a gate of said second MOS transistor.

10. The driver device of a PDP as defined in claim 9, wherein said power supply control circuit controls a power supply voltage at said power supply node of said level shift circuit, and said output node of said level shift circuit is connected to a gate of an MOS transistor on a high potential side of said output buffer circuit.

11. The driver device of a PDP as defined in claim 1, wherein said power supply circuit controls so that a power supply voltage of said level shift circuit is at least a higher voltage of a first voltage and a second predetermined voltage, where the first voltage is equal to a sum of the power supply voltage of said output buffer circuit and the threshold voltage of said MOS transistors and the second voltage is at least the threshold voltage of said MOS transistors, for at least a period of time including the recovery/reuse cycle period of said electric charge recovery circuit.

12. The driver device of a PDP as defined in claim 11, wherein said power supply control circuit comprises:

a power supply unit that outputs said predetermined positive voltage;

a first switch element that switches the connection between an output of said power supply unit and a power supply terminal of said level shift circuit ON and OFF; and a second switch element that switches the connection between a power supply terminal of said output buffer circuit and a power supply terminal of said level shift circuit ON and OFF, wherein said first switch element is ON during a first period when electric charges accumulated in said electric charge recovery circuit are supplied to said data electrode, said first and second switches are OFF during a second period when electric charges remaining on said data electrode are collected in said electric charge recovery circuit, and it is controlled so that said first and second switches are never ON simultaneously.

13. The driver device of a PDP as defined in claim 3, further providing that said first switch is OFF and said second switch is ON during a third period after said first period and before said second period when a voltage is supplied by said electric charge recovery circuit to said power supply terminal of said output buffer circuit.

14. The driver device of a PDF as defined in claim 12, further providing that said first switch is OFF and said second switch is ON during a third period after said first period and before said second period when a voltage is supplied by said electric charge recovery circuit to said power supply terminal of said output buffer circuit.

15. The driver device of a PDP as defined in claim 13, wherein said first, third, and second periods repeat consecutively.

16. The driver device of a PDP as defined in claim 14, wherein said first, third, and second periods repeat consecutively.

17. The driver device for a PDP as defined in claim 13, wherein said first switch changes from ON to OFF and said second switch changes from OFF to ON at a time t2 during said third period when a dropped voltage of the power supply terminal of said level shift circuit becomes the same as the predetermined positive voltage generated by the power supply unit.

18. The driver device for a PDP as defined in claim 14, wherein said first switch changes from ON to OFF and said second switch changes from OFF to ON at a time t2 during said third period when a dropped voltage of the power supply terminal of said level shift circuit becomes the same as the predetermined positive voltage generated by the power supply unit.

19. The driver device for a PDP as defined in claim 17, wherein said second switch comprises a diode.

20. The driver device for a PDP as defined in claim 18, wherein said second switch comprises a diode.

* * * * *